United States Patent [19]

Tsuchiya et al.

[11] Patent Number: 4,805,794

[45] Date of Patent: Feb. 21, 1989

[54] CONTAINER FOR HOUSING METAL STRIP COIL

[75] Inventors: Masanori Tsuchiya, Tokyo; Teruo Suzuki, Yokohama, both of Japan

[73] Assignees: Trade Ocean Line, Ltd.; Nissin Engineering Co., Ltd., both of Yokohama, Japan

[21] Appl. No.: 138,599

[22] Filed: Dec. 28, 1987

[30] Foreign Application Priority Data

Jun. 8, 1987 [JP] Japan ..... 62-141500

[51] Int. Cl.[4] ..... B65D 85/00

[52] U.S. Cl. ..... 220/8; 220/1.5; 206/389; 206/408; 206/409

[58] Field of Search ..... 220/8, 1.5; 206/303, 206/389, 398, 403, 408, 409

[56] References Cited

U.S. PATENT DOCUMENTS

| | | | |
|---|---|---|---|
| 943,202 | 12/1909 | Struss | 206/389 |
| 2,448,447 | 8/1948 | Lau | 206/303 X |
| 2,822,086 | 2/1958 | Franks | 206/303 X |
| 3,608,710 | 9/1971 | Pugh | 206/409 X |
| 3,680,810 | 8/1972 | Jarmalow | 206/408 X |
| 3,907,147 | 9/1975 | Goobeck | 220/1.5 |
| 4,685,633 | 8/1987 | Pellini | 206/389 X |

*Primary Examiner*—Steven M. Pollard

*Attorney, Agent, or Firm*—Frishauf, Holtz, Goodman & Woodward

[57] ABSTRACT

A container for housing a metal strip coil, which comprises: a lower box (2) made of steel, having an open upper end, for housing a metal strip coil (1) with the axis thereof directed horizontally and covering the lower half thereof; an upper box (3) made of steel, having an open lower end and an upper end capable of being opened and closed by means of a pair of shutters (23, 23'), inserted into the lower box (2) so as to be vertically movable, for covering the upper half of the coil (1); a lift mechanism for vertically moving the upper box (3); and a shutter opening-closing mechanism for closing the upper end of the upper box (3) by closing the pair of shutters (23, 23') when the upper box (3) is moved up by means of the lift mechanism, and for opening the upper end of the upper box (3) by opening the pair of shutters (22, 23') when the upper box (3) is moved down by means of the lift mechanism.

8 Claims, 7 Drawing Sheets

CONTAINER FOR HOUSING METAL STRIP COIL

FIELD OF THE INVENTION

The present invention relates to a container for housing a metal strip coil, which is used when transporting the metal strip coil.

BACKGROUND OF THE INVENTION

When transporting a steel strip coil manufactured in a steel works from the steel works to a customer, it is necessary to package the coil to prevent flaws or rust from occurring on the coil and dust from depositing thereon. When transporting a steel strip coil by sea, in particular, the coil must be doubly packaged with the use of water-proof paper and a thin steel sheet.

An example of the process in the case where the coils doubly packaged as described above are transported from a steel works in Japan to Chicago or Detroit in North America is described below.

The thus doubly packaged coils are transported from a steel works to a bonded warehouse near a shipping port, and piled up into a plurality of piles in the bonded warehouse for storage. When a cargo ship arrives, coils to be loaded on the cargo ship are selected from among the coils stored in the bonded warehouse. The thus selected coils are transported to a wharf and temporarily placed there. Then, the coils placed on the wharf are hoisted up by means of a crane, transferred into holds of the cargo ship, and piled up into a plurality of piles in the holds. The thus piled coils are firmly fixed to each other by means of ropes.

The cargo ship loaded with the piled coils departs from the shipping port, passes through the Panama Canal, and reaches the Great Lakes in North America in summer, or reaches the east coast of North America in winter. In either of the above areas, the coils are unloaded from the cargo ship. The unloaded coils are put on a special wagon for coils and transported on this special wagon by rail to Chicago or Detroit which is the final destination.

The conventional packaging and transportation of the coils as described above, have the following problems:

(1) The necessity of double packaging of the coil with the use of water-proof paper and a thin steel sheet requires much labor, time, materials and cost for packaging.

(2) Since loading, unloading and transportation of the coils are carried out a plurality of times as mentioned above during transportation of the coils from the steel works to the final destination, flaws may easily occur on the coils during handling thereof.

(3It is not easy to select coils to be loaded on the cargo ship from among the coils stored in piles in the bonded warehouse and to transport the thus selected coils to the wharf.

(4) When it rains, it is necessary to discontinue transportation of the coils from the bonded warehouse to the wharf and loading of the coils from the wharf on the cargo ship, and to cover the coils on the wharf with a water-proof sheet, thus considerably reducing the handling operation efficiency.

(5) Stabilization of the coils piled up into a plurality of piles in the bonded warehouse or in the holds of the cargo ship, requires many stoppers corresponding to the coil size, and the coils piled up into a plurality of piles in the holds of the cargo ship must be fixed to each other by means of ropes in a large quantity.

(6) When the cargo ship on the voyage suffers from stormy weather or rough sea, the ropes fixing the coils piled up into a plurality of piles in the holds loosen and the coils hit each other, causing flaws on the coils. When rolling and pitching of the cargo sip is serious, furthermore, the ropes fixing the coils may be broken and the released coils may be scattered about in the holds, resulting in the impossibility of gathering them.

(7) In order to transport the unloaded coils on land, it is necessary to use a special wagon for coils, and to transport them by rail. The quantity of transported coils is therefore limited.

(8) When transporting the coils from Japan to Chicago or Detroit, for example, the coils must be transported by sea, as described above, from a shipping port in Japan to the Great Lakes or the east coast of North America on a cargo ship, and then transported by rail to the destination. Until the coils reach the destination, therefore, sea transportation takes about 32 days, and land transportation, about 4 days, requiring a long period of time of about 36 days in total. As a result, coils in a prescribed quantity cannot sometimes be delivered to the customer on or before a prescribed delivery date.

(9) If the coils get wet by rainfall, for example, during handling or transportation thereof, rust may occur on the coils.

Under such circumstances, there is a strong demand for the development of a container for housing a metal strip coil, which permits simplification of packaging of the coil, prevents flaws or rust from occurring on the coil during handling or transportation thereof, allows handling of the coil even in the rain, enables land transportation of the coil without using a special wagon for coils, makes it possible to increase the coil transporting efficiency, and particularly does not require the abovementioned double packaging of the coil, but a container provided with such properties has not as yet been proposed.

SUMMARY OF THE INVENTION

An object of the present invention is therefore to provide a container for housing a metal strip coil, which permits simplification of packaging of the coil, prevents flaws or rust from occurring on the coil during handling or transportation thereof, allows handling of the coil even in the rain, enables land transportation of the coil without using a special wagon for coils, makes it possible to increase the coil transporting efficiency, and particularly does not require the abovementioned double packaging of the coil.

In accordance with one of the features of the present invention, there is provided a container for housing a metal strip coil, comprising:

a lower box (2) made of steel for housing a metal strip coil (1) with the axis thereof directed horizontally and covering the lower half thereof, said lower box (2) comprising a rectangular bottom wall (4) formed into a lattice, four lower side walls (6), an open upper end, and four lower props (5), having an L-shaped cross section, each fixed vertically to each of the four corners of said bottom wall (4), and said lower side walls (6) and said lower props (5) having a height substantially a half that of said coil (1);

an upper box (3) made of steel having a rectangular cross section, inserted into said lower box (2) so as to be vertically movable along said lower props (5), for covering the upper half of said coil (1), said upper box (3) comprising four upper side walls (16), an open lower end, and an upper end capable of being opened and closed by means of a pair of shutters (23, 23'), and said upper side walls (16) having a height substantially a half that of said coil (1);

a lift mechanism for vertically moving said upper box (3), said lift mechanism comprising four cylinders (15) each having an inner bore (15*a*) therein and each fixed vertically to each of the four corners of said upper box (3), four pistons (9) each comprising a piston head (11), having a through-hole (11*a*) at the center thereof, slidably and vertically inserted into said inner bore (15*a*) of each of said cylinders (15) and a hollow piston body (10) vertically fixed to the center of the lower surface of said piston head (11), the lower end of said piston body (10) being fixed to each of the four corners of said bottom wall (4) of said lower box (2), and an air supply pipe (12) for supplying air, through said piston body (10) and said through-hole (11*a*) of said piston head (11), into said inner bore (15*a*) of each of said cylinders (15), and discharging air in said inner bore (15*a*) of each of said cylinders (15), through said through-hole (11*a*) of said piston head (11) and said piston body (10); and a shutter opening-closing mechanism for closing said upper end of said upper box (3) by closing said pair of shutters (23, 23') when said upper box (3) is moved up by means of said lift mechanism, and for opening said upper end of said upper box (3) by opening said pair of shutters (23, 23') when said upper box (3) is moved down by means of said lift mechanism, said shutter opening-closing mechanism comprising a pair of inverse U-shaped guide rails (22, 22'), symmetrically provided on the inner surfaces of a set of said upper side walls (16) opposed to each other of said upper box (3), for symmetrically guiding said pair of shutters (23, 23'), a pair of shutter rewinding rollers (24, 24'), each provided on each of the both sides of said bottom wall (4) of said lower box (2), for rewinding respectively each of said pair of shutters (23, 23'), and four ropes (25, 25'), one end of each of which is fixed to each of the both sides of a leading end of each of said pair of shutters (23, 23') and the other end of each of which is fixed to the lower portion of said upper box (3), each of said ropes (25, 25') having a length substantially equal to that of the circumference in the vertical direction of said upper box (3) and being extended along each of said pair of guide rails (22, 22'), said upper side wall (16) of said upper box (3) and said bottom wall (4) of said lower box (2).

DETAILED DESCRIPTION OF PREFERRED EMBODIMENTS

Figure 1:
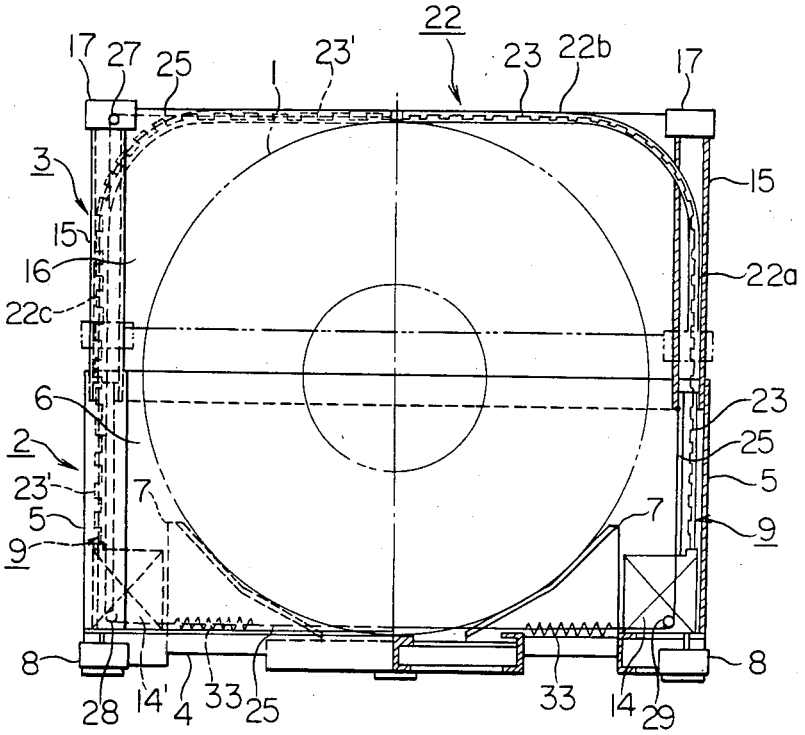
FIG. 1 is a partially cutaway schematic front view illustrating a first embodiment of the container of the present invention.

From the above-mentioned point of view, extensive studies were carried out with a view to developing a container for housing a metal strip coil, which permits simplification of packaging of the coil, prevents flaws or rust from occurring on the coil during handling or transportation thereof, allows handling of the coil even in the rain, enables land transportation of the coil without using a special wagon for coils, makes it possible to increase the coil transporting efficiency, and particularly does not require the above-mentioned double packaging of the coil.

As a result, there was obtained a finding that the above-mentioned problems can be solved by using a container for housing a metal strip coil, which comprises: a lower box made of steel having an open upper end, for housing a metal strip coil with the axis thereof directed horizontally and covering the lower half thereof; an upper box made of steel, having an open lower end and an upper end capable of being opened and closed by means of a pair of shutters, inserted into the lower box so as to be vertically movable, for covering the upper half of the coil; a lift mechanism for vertically moving the upper box; and a shutter opening-closing mechanism for closing the upper end of the upper box by closing the pair of shutters when the upper box is moved up by means of the lift mechanism, and for opening the upper end of the upper box by opening the pair of shutters when the upper box is moved down by means of the lift mechanism; and by housing the metal strip coil in the above-mentioned container.

The present invention was made on the basis of the above-mentioned finding. Now, a first embodiment of the container for housing a metal strip coil of the present invention is described below with reference to FIGS. 1 to 7.

The container for housing a metal strip coil of the present invention comprises as shown in FIGS. 1 to 7: a lower box 2 made of steel, having an open upper end, for housing a metal strip coil 1 with the axis thereof directed horizontally and covering the lower half thereof; an upper box 3 made of steel, having an open lower end and an upper end capable of being opened and closed by means of a pair of shutters 23, 23', inserted into the lower box 2 so as to be vertically movable, for covering the upper half of the coil 1; a lift mechanism for vertically moving the upper box 3; and a shutter opening-closing mechanism for closing the upper end of the upper box 3 by closing the pair of shutters 23, 23' when the upper box 3 is moved up by means of the lift mechanism, and for opening the upper end of the upper box 3 by opening the pair of shutters 23, 23' when the upper box 3 is moved down by means of the lift mechanism.

The lower box 2 is made of steel and comprises a rectangular bottom wall 4 formed, with channel-shaped steel members for example, into a lattice, four lower side walls 6 made of a steel sheet, an open upper end, and four lower props 5 made of steel, having an L-shaped cross section, each fixed vertically to each of the four corners of the bottom wall 4. The bottom wall 4 has an area sufficient to house a metal strip coil 1 with the axis thereof directed horizontally. The lower side walls 6 and the lower props 5 have a height substantially a half that of the coil 1. A plurality of coil supports 7 are provided on the bottom wall 4 for stationarily supporting the coil 1 housed in the lower box 2. Each of the lower surfaces of the four corners of the bottom wall 4 is provided with a lower corner fitting 8.

The upper box 3 is made of steel and has a rectangular cross section. The upper box 3 comprises four side walls 16 made of a steel sheet, an open lower end, and an upper end capable of being opened and closed by means of a pair of shutters 23, 23'. The upper box 3 is inserted into the lower box 2 so as to be vertically movable along the lower props 5 of the lower box 2. The upper side walls 16 have a height substantially a half that of the coil 1.

Figure 3:
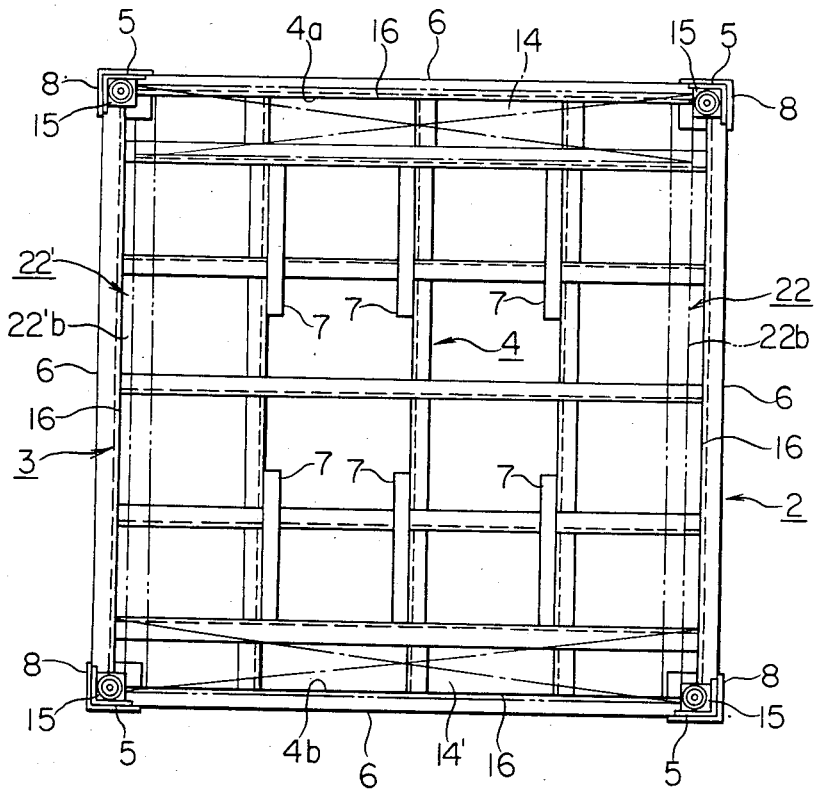
FIG. 3 is a schematic plan view of the container of the present invention shown in FIG. 1, excluding some components thereof.
Figure 4:
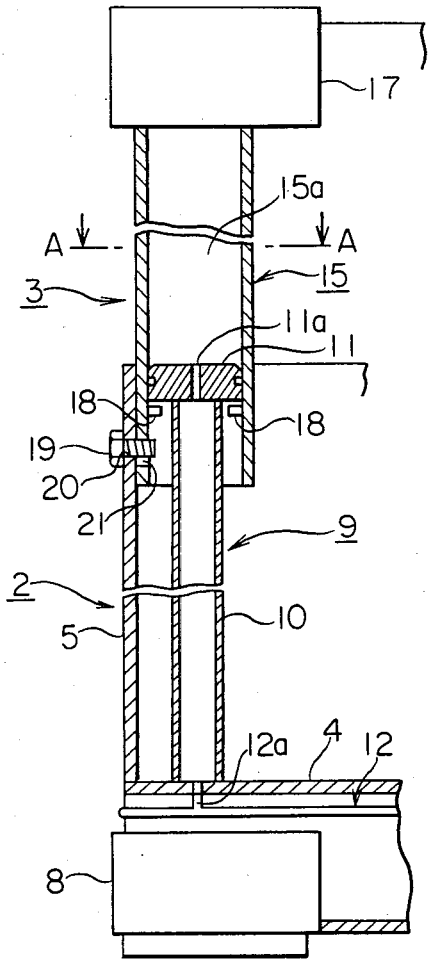
FIG. 4 is an enlarged schematic vertical sectional view illustrating the lift mechanism which is one of the components of the container of the present invention shown in FIG. 1.
Figure 5:
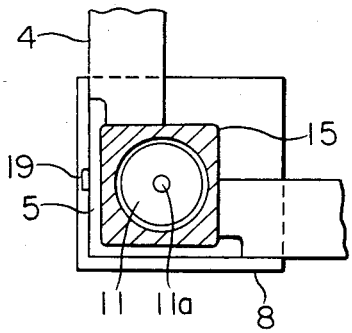
FIG. 5 is a sectional view of FIG. 4 cut along the line A—A.

The lift mechanism for vertically moving the upper box 3 comprises four cylinders 15, four pistons 9 and an air supply pipe 12, as shown in FIGS. 3 to 5. Each of the cylinders 15 is made of a rectangular steel pipe and has therein a circular inner bore 15*a*. Each of the cylinders 15 is vertically fixed to each of the four corners of the upper box 3 closely adjacent to each of the lower props 5. The height of the cylinders 15 is substantially equal to that of the upper side walls 16 of the upper box 3. The upper end of each of the cylinders 15 is provided with an upper corner fitting 17, by means of which the upper end of each of the cylinders 15 is airtightly closed.

Each of the pistons 9 comprises a piston head 11 having a through-hole 11*a* to the center thereof and a hollow piston body 10 vertically fixed to the center of the lower surface of the piston head 11. The piston head 11 is slidably and vertically inserted into the inner bore 15*a* of each of the cylinders 15, and the lower end of the piston body 10 is fixed to each of the four corners of the bottom wall 4 of the lower box 2. The height of the pistons 9 is substantially equal to that of the lower side walls 6 of the lower box 2.

Figure 2:
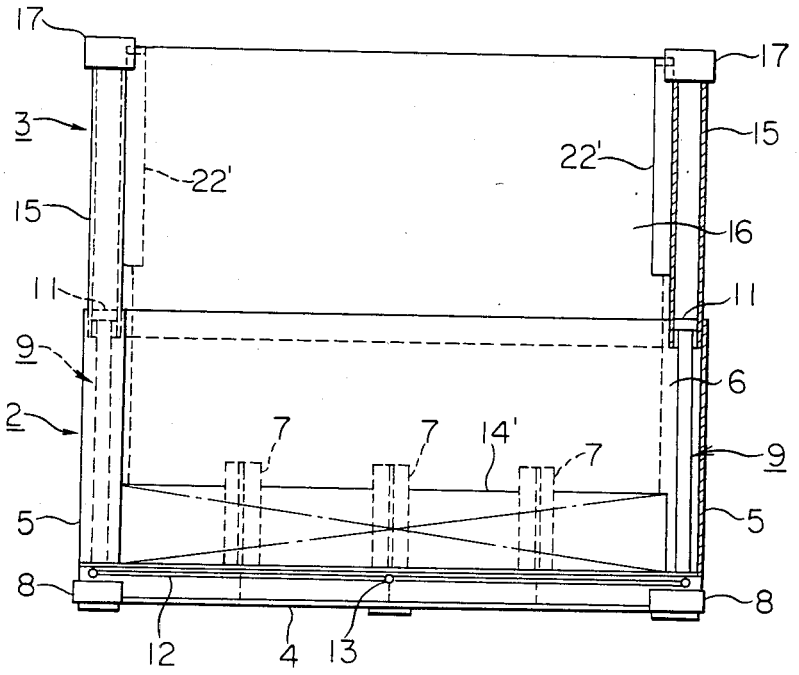
FIG. 2 is a partially cutaway schematic side view of the container of the present invention shown in FIG. 1.

The air supply pipe 12 is horizontally provided on the bottom wall 4 of the lower box 2, and connected via a branch pipe 12*a* to each of the hollow piston bodies 10 fixed to each of the four corners of the bottom wall 4 of the lower box 2. As shown in FIG. 2, a hose connector 13 for connecting a hose (not shown) from a compressed air tank (not shown) is provided in the middle of the air supply pipe 12. The air supply pipe 12 supplies air from the compressed air tank (not shown) through the hollow piston body 10 and the through-hole 11*a* of the piston head 11 into the inner bore 15a of each of the cylinders 15, and discharges air in the inner bore 15*a* of each of the cylinders 15 through the through-hole 11*a* of the piston head 11 and the hollow piston body 10. Thus, the upper box 3 is moved up by supplying air into the inner bore 15*a* of each of the cylinders 15, and the upper box 3 is moved down by discharging air from the inner bore 15*a* of each of the cylinders 15.

It is preferred to provide, as shown in FIG. 4, at least one stopper 18 on the lower portion of the inner bore 15*a* of each of the cylinders 15 in order to prevent each of the pistons 9 from coming off each of the cylinders 15.

The shutter opening-closing mechanism comprises a pair of inverse U-shaped guide rails 22, 22', symmetrically provided on the inner surfaces of a set of upper side walls 16 opposed to each other of the upper box 3, for symmetrically guiding the pair of shutters 23, 23', a pair of shutter rewinding rollers 24, 24', each provided on each of the both sides of the bottom wall 4 of the lower box 2, for rewinding respectively each of the pair of shutters 23, 23', and four ropes 25, 25', one end of each of which is fixed to each of the both sides of the leading end of each of the pair of shutters 23, 23' and the other end of each of which is fixed to the lower portion of the upper box 3.

The pair of inverse U-shaped guide rails 22, 22' are symmetrically provided over the upper edge and the side edges of the inner surfaces of the set of the upper side walls 16 opposed to each other of the upper box 3. Each of the pair of shutter rewinding rollers 24, 24' is rotatably provided in each of a pair of shutter casings 14, 14' provided on each of the both sides 4*a*, 4*b* of the bottom wall 4 of the lower box 2. Openings 14a, 14'a for passing the pair of shutters 23, 23' are provided respectively on the upper surfaces of the shutter casings 14, 14'. Each of the shutter rewinding rollers 24, 24' is provided with a spring (not shown) for imparting a driving force for rewinding each of the pair of shutters 23, 23' to each of the shutter rewinding rollers 24, 24'.

Figure 6:
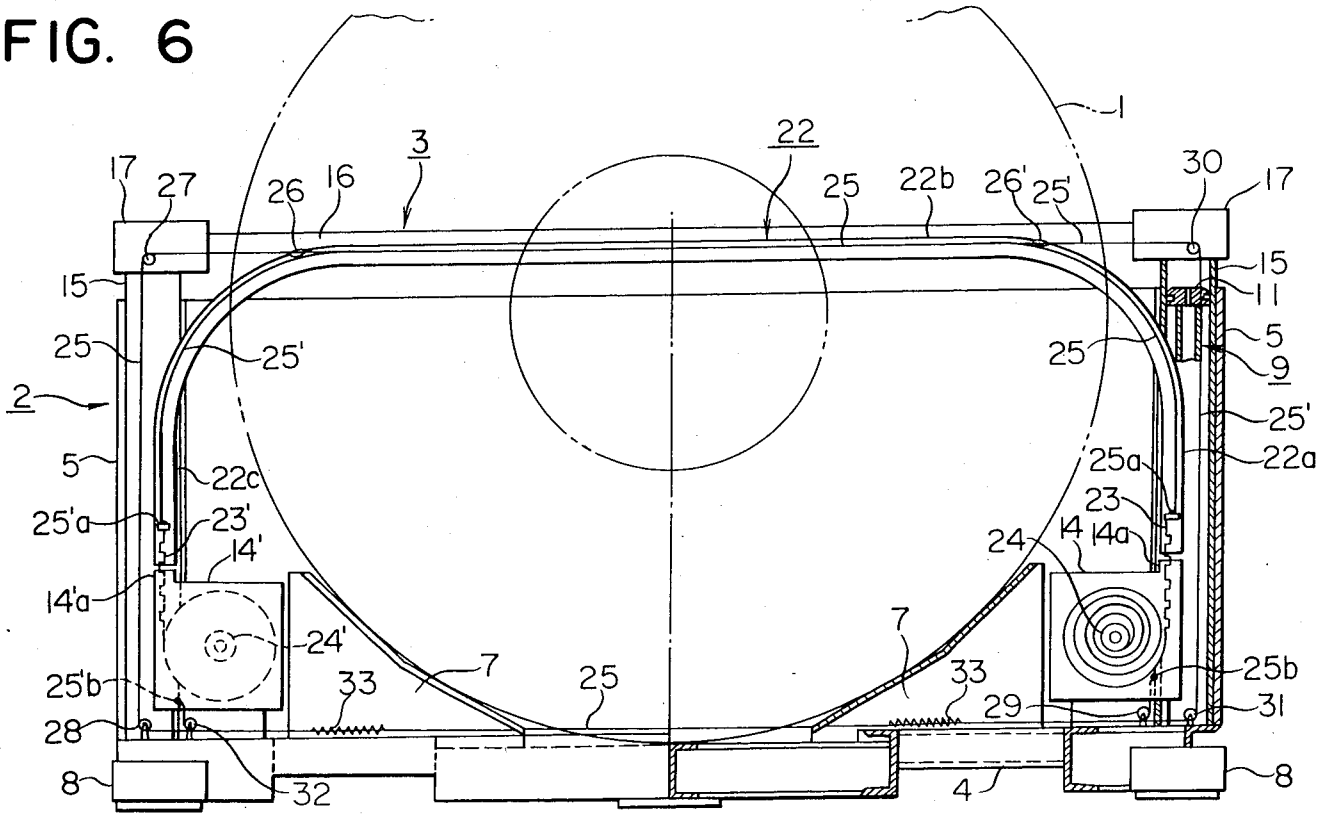
FIG. 6 is a partially cutaway schematic front view illustrating the shutter opening-closing mechanism which is one of the components of the container of the present invention shown in FIG. 1.
Figure 7:
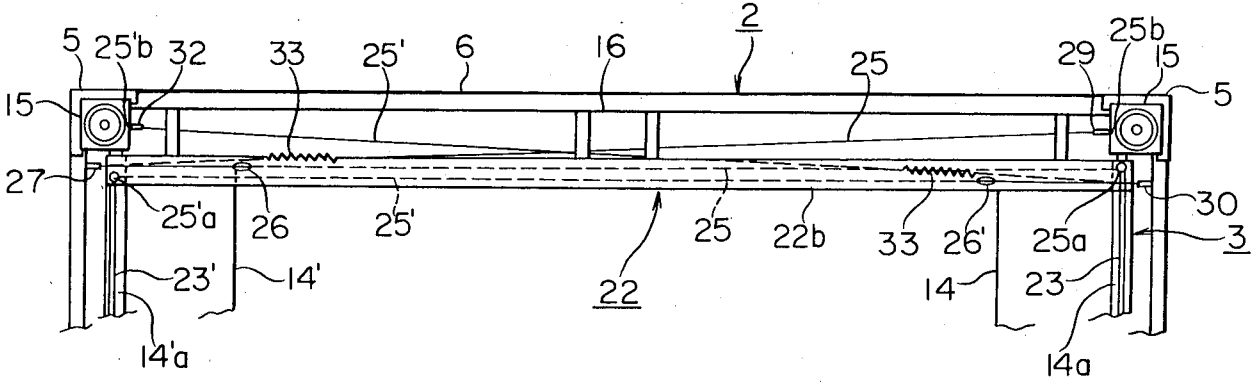
FIG. 7 is a schematic plan view of the shutter opening-closing mechanism shown in FIG. 6.

As shown in FIGS. 6 and 7, each of the four ropes 25, 25' has a length substantially equal to that of the circumference in the vertical direction of the upper box 3, and is extended along each of the pair of guide rails 22, 22', the upper side wall 16 of the upper box 3 and the bottom wall 4 of the lower box 2.

One end 25*a* of each of a set of ropes 25 for the one shutter 23 is fixed to each of the both sides of the leading end of the one shutter 23, and the other end 25*b* of each of the set of ropes 25 is fixed to the lower portion of the upper box 3 on the side of the one shutter 23.

Now, the path of one of the set of ropes 25 is described with reference to FIGS. 3, 6 and 7. The rope 25, the one end 25*a* of which is fixed to the leading end of the one shutter 23, passes through one vertical section 22*a* and a horizontal section 22*b* following the one vertical section 22*a* of the one inverse U-shaped guide rail 22, and comes out from the one guide rail 22 through a hole 26 provided on one end of the horizontal section 22*b* of the one guide rail 22. Then, the rope 25 is vertically and downwardly directed through a guide roller 27 provided on the upper portion of the one upper side wall 16 of the upper box 3 and a guide roller 28 provided on the one side of the bottom wall 4 of the lower box 2. Then, the rope 25 is horizontally directed along the bottom wall 4 of the lower box 2 through a guide roller 29 provided on the other side of the bottom wall 4, and thus makes substantially a turn around the interior of the upper box 3. The other end 25*b* of the rope 25 is fixed, through the guide roller 29, to the lower portion of the upper box 3 on the side of the one shutter 23.

One end 25'*a* of each of a set of ropes 25' for the other shutter 23' is fixed to each of the both sides of the leading end of the other shutter 23', and the other end 25'*b* of each of the set of ropes 25' is fixed to the lower portion of the upper box 3 on the side of the other shutter 23'.

Now, the path of one of the set of ropes 25' is described with reference to FIGS. 3, 6 and 7. The rope 25', the one end 25'a of which is fixed to the leading end of the other shutter 23', passes through the other vertical section 22c and the horizontal section 22b following the other vertical section 22c of the one inverse U-shaped guide rail 22, and comes out from the one guide rail 22 through another hole 26' provided on the other end of the horizontal section 22b of the one guide rail 22. Then the rope 25' is vertically and downwardly directed through a guide roller 30 provided on the upper portion of the other upper side wall 16 of the upper box 3 and a guide roller 31 provided on the other side of the bottom wall 4 of the lower box 2. Then, the rope 25' is horizontally directed along the bottom wall 4 of the lower box 2 through a guide roller 32 provided on the one side of the bottom wall 4, and thus makes substantially a turn around the interior of the upper box 3. The other end 25'b of the rope 25' is fixed, through the guide roller 32, to the lower portion of the upper box 3 on the side of the other shutter 23'.

Each of the four ropes 25, 25' has in the middle thereof at least one spring 33 for imparting tension to each of the four ropes 25, 25'. Elasticity of the spring 33 is preferably larger than that of the spring (not shown) provided on each of the shutter rewinding rollers 24, 24'.

As shown in FIGS. 4 and 5, the container of the present invention has a fixing mechanism for fixing the upper box 3, moved up to the uppermost position thereof by means of the above-mentioned lift mechanism, to the lower box 2. The fixing mechanism comprises four pinning holes 20 each provided on the upper portion of each of the lower props 5 of the lower box 2, another four pinning holes 21 each provided on the lower portion of each of the cylinders 15 and associated with each of the pinning holes 20, and four pins 19 each of which is to be releasably inserted into each set of the pinning hole 20 and the another pinning hole 21 which associate with each other. After moving up the upper box 3 to the uppermost position thereof by means of the lift mechanism, the upper box 3 is fixed to the lower box 2 by inserting each of the pins 19 into each set of the pinning hole 20 and the another pinning hole 21 which associate with each other.

According to the container for housing a metal strip coil of the present invention as described above, the coil 1 is housed in the container as described herebelow. As shown by a two-point chain line in FIG. 1 and also in FIG. 6, the upper box 3 is moved down into the lower box 2. In this position, most portions of each of the pair of shutters 23, 23' are rewound on each of the pair of shutter rewinding rollers 24, 24', and thus the upper end of the upper box 3 is opened. In this state, the coil 1 is housed in the lower box 2 with the axis of the coil 1 directed horizontally, and is stationarily supported by means of the plurality of coil supports 7 provided on the bottom wall 4 of the lower box 2. Because the height of the container in this state is substantially a half that of the coil 1 and the upper half of the coil 1 is exposed out of the container, the coil 1 can easily be housed in the lower box 2 with the use of a crane.

Then, compressed air under pressure of from 5 to 7 Kg/cm², for example, is supplied from the compressed air tank (not shown) into the inner bore 15a of each of the four cylinders 15 through the hose (not shown) connected to the hose connector 13, the air supply pipe 12, the branch pipe 12a, the hollow piston body 10, and the through-hole 11a of the piston head 11. As a result, the upper box 3 is moved up to the uppermost position thereof along the lower props 5 of the lower box 2 under the effect of pressure of the compressed air thus supplied. In this case, the at least one stopper 18 each provided on the lower portion of the inner bore 15a of each of the cylinders 15 prevents each of the pistons 9 from coming off each of the cylinders 15.

As described above, as the upper box 3 is moved up, the pair of shutters 23, 23' are pulled by the ropes 25, 25' and are symmetrically veered out from the pair of shutter rewinding rollers 24, 24' along the pair of inverse U-shaped guide rails 22, 22'. The leading ends of the pair of shutters 23, 23' finally come into contact with each other at the center of the horizontal portions 22b, 22'b of the pair of guide rails 22, 22'. Since tension is imparted to each of the ropes 25, 25' by means of the spring 33, it is possible to bring the leading ends of the pair of shutters 23, 23' into close contact, and thus, the upper end of the upper box 3 is closed.

Then, after the box 3 is moved up to the uppermost position thereof as mentioned above, the upper box 3 is fixed to the lower box 2 by inserting the pin 19 into each set of the pinning hole 20 provided on the upper portion of each of the lower props 5 of the lower box 2 and the another pinning hole 21 provided on the lower portion of each of the cylinders 15, which associate with each other. Subsequently, the hose (not shown) from the compressed air tank (not shown) is taken off from the hose connector 13 provided in the middle of the air supply pipe 12. Thus, the upper half of the coil 1 is covered with the upper box 3, and the coil 1 is completely housed in the container.

The container in which the coil 1 is housed as described above is transported to the destination by sea and on land, where the coil 1 is taken out from the container as described below. A small amount of compressed air is supplied from a compressed air tank (not shown) into the inner bore 15a of each of the four cylinders 15 through the hose (not shown) connected to the hose connector 13, the air supply pipe 12, the branch pipe 12a, the hollow piston body 10, and the through-hole 11a of the piston head 11 to cause the upper box 3 to slightly move up. Then, the pins 19 are removed from each set of the pinning hole 20 and the another pinning hole 21.

Subsequently, the hose (not shown) from the compressed air tank (not shown) is taken off from the hose connector 13 provided in the middle of the air supply pipe 12 and air in the inner bore 15a of each of the four cylinders 15 is discharged through the throughhole 11a of the piston head 11, the hollow piston body 10, the branch pipe 12a and the air supply pipe 12. As a result, the upper box 3 moves down into the lower box 2, under its own weight, along the lower props 5 of the lower box 2. As the upper box 3 moves down, the ropes 25, 25' loosen, and as a result, the pair of shutters 23, 23' having closed the upper end of the upper box 3 are rewound by means of the pair of shutter rewinding rollers 24, 24'. Thus, the upper box 3 moves down into the lower box 2, and the upper end of the upper box 3 is opened. The coil 1 can therefore be easily taken out from the lower box 2 with the use of a crane, because the height of the container in this state is substantially a half that of the coil 1 and the upper half of the coil 1 is exposed out of the container as described above.

Figure 8:
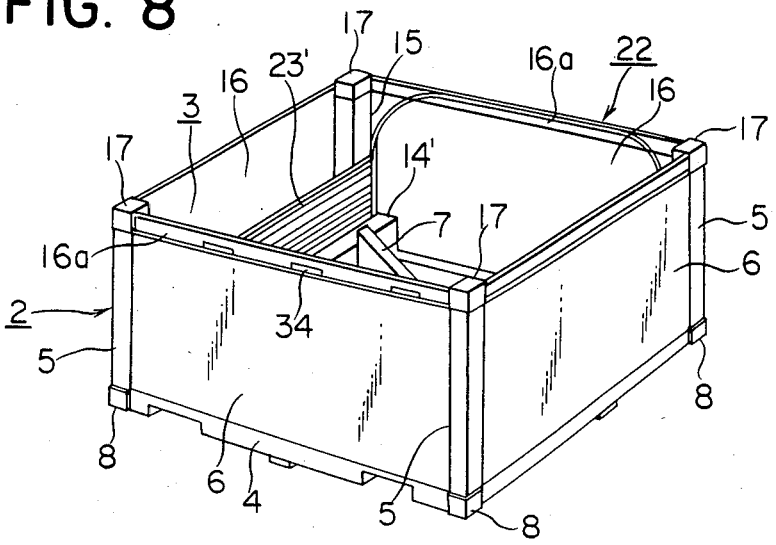
FIG. 8 is a schematic perspective view illustrating a second embodiment of the container of the present invention in a state in which the upper box is moved down to the lowermost position thereof and the upper end thereof is opened.
Figure 9:
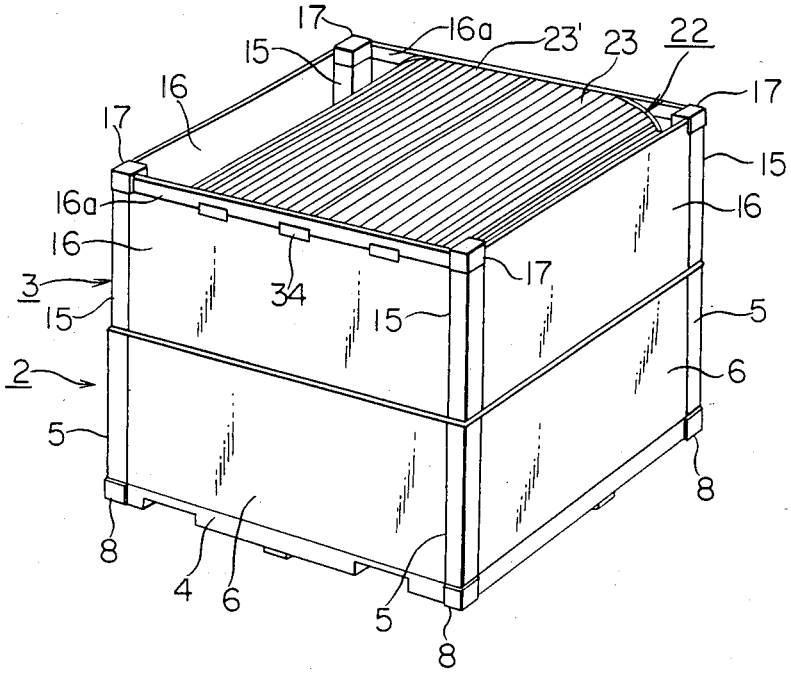
FIG. 9 is a schematic perspective view illustrating the container of the present invention shown in FIG. 8 in a state in which the upper box is moved up to the uppermost position thereof and the upper end thereof is closed.

Now, a second embodiment of the container for housing a metal strip coil of the present invention is described below with reference to FIGS. 8 and 9. As shown in FIGS. 8 and 9, in the container of the second embodiment, the height of the lower side walls 6 and the lower props 5 of the lower box 2 is slightly smaller than a half that of the coil 1, and the height of the upper side walls 16 of the upper box 3 is slightly larger than a half that of the coil 1. In addition, in the container of the second embodiment, each of a set of the upper side walls 16 opposed to each other of the upper box 3 has an upper end portion 16a which is openable toward the outside by means of a plurality of hinges 34. More specifically, each of the upper side walls 16 of the upper box 3 is higher than each of the lower side walls 6 of the lower box 2 by the height of the upper end portion **16*a*. The portions of the pairs of inverse U-shaped guide rails 22, 22', which are secured to the upper end portions 16*a* of the upper side walls 16, have slits at the connecting parts of the upper end portions 16*a*. When the upper end portions 16*a* are closed, the upper end portions 16*a* are releasably secured to the upper corner fittings 17**. The construction of the container of the second embodiment is the same as that of the container of the first embodiment except for the foregoing.

Since the container of the second embodiment has the construction as described above, the coil 1 can very easily be housed into, and taken out from, the lower box 2 by opening toward the outside the upper end portions **16*a* of the set of opposing upper side walls 16 of the upper box 3**. This is because the container in this state of the second embodiment is lower than the container in the same state of the first embodiment.

As described above in detail, according to the container for housing a metal strip coil of the present invention, the following industrially useful effects are provided:

(1) The coil 1 is housed into the lower box 2 in the state in which the upper box 3 is moved down into the lower box 2 and the upper end of the upper box 3 is opened, and then the upper end of the upper box 3 is automatically closed by means of the pair of shutters 23, 23' by moving up the upper box 3, whereby the coil 1 is completely housed into the container. On the other hand, the upper end of the upper box 3, which has been closed by means of the pair of shutters 23, 23', is automatically opened by moving down the upper box 3 into the lower box 2. Thus, the coil 1 can simply and rapidly be housed into and taken out from the container.

(2) It is no longer necessary to doubly package the coil by the use of water-proof paper and a thin steel sheet as before, but is suffices to package the coil only with water-proof paper. Therefore, it is possible to save materials for coil packaging and to package the coil rapidly, easily and economically.

(3) The coil is loaded, unloaded and transported in the state as housed in the container. Flaws or rust does not therefore occur on the coil during handling or transportation thereof, and the coil can be handled even in the rain.

(4) When loading the coils on a cargo ship, it is not required to store the coils housed in the containers in a warehouse, but it suffices to store them on the wharf, thus improving the handling efficiency of coils.

(5) Stoppers and ropes are not required as before for fixing the coils piled up into a plurality of piles in the holds of the cargo ships. In addition, even when rolling and pitching are serious on the cargo ship on a voyage suffering from stormy weather or rough sea, flaws are not produced on the coils, and the coils are never released and never scattered about in the holds.

(6) A special wagon for coils as before is not necessary for land transportation of the coils, and an ordinary wagon or a truck may be used. Therefore, when transporting the coils from Japan to Chicago or Detroit, for example, it is possible to transport the coils housed in the containers on a cargo ship by sea from a shipping port in Japan to the west coast of North America, and then transport them to the destination on an ordinary wagon on land. As a result, the number of days for transporting of the coils to the destination can be reduced to about a half that as before, thus remarkably improving the transporting efficiency.

(7) The empty containers after unloading the coils at the destination can be sent back in the state in which the upper box 3 is moved down into the lower box 2. This permits return of many containers at a time, and loading of bulk cargo in the containers on the way back.

What is claimed is:

1. A container for housing a metal strip coil, comprising:

a lower box (2) made of steel for housing a metal strip coil (1) with the axis thereof directed horizontally and covering the lower half thereof, said lower box (2) comprising a rectangular bottom wall (4) formed into a lattice, four lower side walls (6), an open upper end, and four lower props (5), having an L-shaped cross section, each fixed vertically to each of the four corners of said bottom wall (4), and said lower side walls (6) and said lower props (5) having a height substantially a half that of said coil (1);

an upper box (3) made of steel having a rectangular cross section, inserted into said lower box (2) so as to be vertically movable along said lower props (5), for covering the upper half of said coil (1), said upper box (3) comprising four upper side walls (16), an open lower end, and an upper end which is openable and closeable by means of a pair of shutters (23, 23'), and said upper side walls (16) having a height substantially a half that of said coil (1), each of said shutters having a leading end; (15) each having an inner bore (**15*a*) therein and each fixed vertically to each of the four corners of said upper box (3), four pistons (9) each comprising a piston head (11), having a through-hole (11*a*) at the center thereof, slidably and vertically inserted into said inner bore (15*a*) of each of said cylinders (15) and a hollow piston body (10) vertically fixed to the center of the lower surface of said piston head (11), the lower end of said piston body (10) being fixed to each of the four corners of said bottom wall (4) of said lower box (2), and an air supply pipe (12) for supplying air, through said piston body (10) and said through-hole (11*a*) of said piston head (11), into said inner bore (15*a*) of each of said cylinders (15), and discharging air in said inner bore (15*a*) of each of said cylinders (15), through said through-hole (11*a*) of said piston head (11) and said piston body (10); and a shutter opening-closing mechanism for closing said upper end of said upper box (3) by closing said pair of shutters (23, 23') when said upper box (3) is moved up by means of said lift mechanism, and for opening said upper end of said upper box (3) by opening said pair of shutters (23, 23') when said upper box (3**) is moved down by means of said lift mechanism, said shutter opening-closing mechanism comprising a pair of inverse U-shaped guide rails (22, 22'), symmetrically provided on the inner surfaces of a set of said upper side walls (16) opposed to each other of said upper box (3), for symmetrically guiding said pair of shutters (23, 23'), a pair of shutter rewinding rollers (24, 24'), each provided on each of the both sides of said bottom wall (4) of said lower box (2), for rewinding respectively each of said pair of shutters (23, 23'), and four ropes (25, 25'), one end of each of which is fixed to each of the both sides of the leading end of each of said pair of shutters (23, 23') and the other end of each of which is fixed to the lower portion of said upper box (3), each of said ropes (25, 25') having a length substantially equal to that of the circumference in the vertical direction of said upper box (3) and being extended along each of said pair of guide rails (22, 22'), said upper side wall (16) of said upper box (3) and said bottom wall (4) of said lower box (2).

2. The container as claimed in claim 1, further comprising:

a fixing mechanism for fixing said upper box (3), moved up to the uppermost position thereof by means of said lift mechanism, to said lower box (2), said fixing mechanism comprising four pinning holes (20) each provided on an upper portion of each of said lower props (5) of said lower box (2), another four pinning holes (21) each provided on a lower portion of each of said cylinders (15) and associated with each of said pinning holes (20), and four pins (19) each of which is releasably insertable into each set of said pinning hole (20) and said another pinning hole (21) which associate with each other.

3. The container as claimed in claim 2, further comprising:

at least one stopper (18) provided on a lower portion of said inner bore (15*a*) of each of said cylinders (15), for preventing each of said pistons (9) from coming off each of said cylinders (15).

4. The container as claimed in claim 2, each of said four ropes (25, 25') of said shutter opening-closing mechanism has in a middle portion thereof at least one spring (33) for imparting tension to each of said ropes (25, 25').

5. The container as claimed in claim 2 wherein:

the height of said lower side walls (6) and said lower props (5) of said lower box (2) is slightly smaller than a half that of said coil (1);

the height of said upper side walls (16) of said upper box (3) is slightly larger than a half that of said coil (1);

each of a set of said upper side walls (16) opposed to each other of said upper box (3) having an upper end portion (16*a*) which is openable toward the outside by means of a plurality of hinges (34); and each of said upper side walls (16) of said upper box (3) is higher than each of said lower side walls (6) of said lower box (2) by the height of said upper end portion (16*a*).

6. The container as claimed in clim 1, further comprising:

at least one stopper (18) provided on a lower portion of said inner bore (15*a*) of each of said cylinders (15), for preventing each of said pistons (9) from coming off each of said cylinders (15).

7. The container as claimed in claim 1, wherein:

each of said four ropes (25, 25') of said shutter opening-closing mechanism has in a middle portion thereof at least one spring (33) for imparting tension to each of said ropes (25, 25').

8. The container as claimed in claim 1, wherein:

the height of said lower side walls (6) and said lower props (5) of said lower box (2) is slightly smaller than a half that of said coil (1);

the height of said upper side walls (16) of said upper box (3) is slightly larger than a half that of said coil (1);

each of a set of said upper side walls (16) opposed to each other of said upper box (3) having an upper end portion (16*a*) which is openable toward the outside by means of a plurality of hinges (34); and each of said upper side walls (16) of said upper box (3) is higher than each of said lower side walls (6) of said lower box (2) by the height of said upper end portion (16*a*).

* * * * *